US012434107B2

(12) United States Patent
Warner

(10) Patent No.: US 12,434,107 B2
(45) Date of Patent: Oct. 7, 2025

(54) BOUNCING TOY WITH PLUSH EXTERIOR

(71) Applicant: Ty Inc., Westmont, IL (US)

(72) Inventor: Ty Warner, Westmont, IL (US)

(73) Assignee: Ty Inc., Westmont, IL (US)

( * ) Notice: Subject to any disclaimer, the term of this patent is extended or adjusted under 35 U.S.C. 154(b) by 0 days.

(21) Appl. No.: 18/583,565

(22) Filed: Feb. 21, 2024

(65) Prior Publication Data

US 2025/0262486 A1 Aug. 21, 2025

(51) Int. Cl.
*A63B 37/00* (2006.01)
*A63H 3/02* (2006.01)

(52) U.S. Cl.
CPC ..... *A63B 37/00* (2013.01); *A63H 3/02* (2013.01)

(58) Field of Classification Search
CPC ... A63B 37/00; A63B 43/008; A63B 2208/12; A63B 2209/00; A63B 39/06; A63B 43/002; A63B 2039/003; A63H 3/02; A63H 3/003
USPC ..... 446/97–101, 183, 221, 226, 267, 446/369–372, 385, 390
See application file for complete search history.

(56) References Cited

U.S. PATENT DOCUMENTS 1,216,425 A * 2/1917 Eiseman ..... A63H 3/06 446/226
1,218,852 A * 3/1917 Gilpin ..... A63H 27/10 446/224
D142,395 S * 9/1945 Fish et al. ..... D21/655
3,241,834 A * 3/1966 Stingley ..... A63B 37/00 473/569
3,396,970 A * 8/1968 Fraser, Jr. ..... A63B 39/06 473/607
3,512,777 A * 5/1970 Henderson ..... A63B 41/08 156/170
4,261,565 A * 4/1981 Massino, Sr. ..... A63B 45/00 156/186
4,568,083 A * 2/1986 Miller ..... B29D 99/0042 156/292
5,026,054 A * 6/1991 Osher ..... A63B 37/06 446/385
D323,865 S * 2/1992 Clarke ..... D21/604
5,141,465 A * 8/1992 Stellman ..... A63H 3/02 273/DIG. 30
5,413,331 A * 5/1995 Stillinger ..... A63B 39/06 473/599
5,647,590 A * 7/1997 Walker ..... A63B 37/00 473/601
5,798,411 A * 8/1998 Riazi ..... C08K 3/26 524/425

(Continued)

FOREIGN PATENT DOCUMENTS

AU 200018489 B2 * 9/2000
CN 211097505 U 7/2020
KR 101976654 B1 5/2019

OTHER PUBLICATIONS

Kinarp, How to Make a Pig Round Ball Plushie Youtube, Nov. 24, 2020, https://www.youtube.com/watch?v=IZxbEoziyXI.*

(Continued)

*Primary Examiner* — Nini F Legesse
(74) *Attorney, Agent, or Firm* — Husch Blackwell LLP

(57) ABSTRACT

The present application relates to a toy comprising an internal ball structure comprising a highly resilient material capable of significant bouncing off a hard surface, a plush fabric skin configured to cover the internal ball structure such that the plush fabric exterior does not significantly impact or dampen the ability of the internal bouncing ball structure to bounce when impacting a surface.

18 Claims, 4 Drawing Sheets

(56) References Cited

U.S. PATENT DOCUMENTS

| | | | | | |
|---|---|---|---|---|---|
| 5,893,811 | A * | 4/1999 | Stover | A63B 43/02 | 473/576 |
| 6,126,510 | A * | 10/2000 | Weiss, Jr. | A63H 3/02 | 446/431 |
| D442,657 | S * | 5/2001 | Long | D21/714 | |
| 6,224,513 | B1 * | 5/2001 | Chow | A63B 37/12 | 482/49 |
| 6,517,406 | B1 * | 2/2003 | Cash | A63H 3/16 | 446/390 |
| 7,384,324 | B2 * | 6/2008 | Fullmer | A63H 3/02 | 446/369 |
| 9,248,348 | B2 * | 2/2016 | Newman | A63B 37/12 | |
| 10,576,390 | B2 * | 3/2020 | Rosenbaum | A63H 3/02 | |
| 2005/0130555 | A1 * | 6/2005 | Munoz Urrea | A63H 3/06 | 446/226 |
| 2005/0233676 | A1 * | 10/2005 | Bohart | A63H 3/06 | 446/313 |
| 2009/0071412 | A1 * | 3/2009 | Ritchey | A01K 15/025 | 119/709 |
| 2011/0146586 | A1 * | 6/2011 | Turner | A01K 15/025 | 119/709 |
| 2014/0342859 | A1 * | 11/2014 | Newman | A63B 45/00 | 473/607 |
| 2015/0045191 | A1 * | 2/2015 | Carter | A63B 41/125 | 482/93 |

OTHER PUBLICATIONS

Amazon. Inpany—Outdoor-Dinosaur, Nov. 17, 2021. https://www.amazon.com/INPANY-Outdoor-Dinosaur-Birthday-Included/dp/B0CCVDJQRV?th=1 (Year: 2021).*

Amazon, Plush Crush—Surprise-Collectible. Review of product provided on Nov. 5, 2019 https://www.amazon.com/Plush-Crush-Surprise-Collectible-Character/dp/B0BXMPW846/ref=cm_cr_arp_d_product_top?ie=UTF8& th=1 (Year: 2019).*

How to Make a Fabric Balloon Ball (YouTube: https://www.youtube.com/watch?v=1uyqXpQkTmY). Jul. 9, 2021 (Year: 2021).*

Kawaii Plush YouTube video (https://www.youtube.com/watch?v=EWZSQXa40Rg&t=22s). Nov. 10, 2016 (Year: 2016).*

Seasonofdreams via eBay "Paw Patrol Rubble Plush Bouncing Ball Nickelodeon Kids Cartoon Teddy Bear Toy", retrieved on Mar. 27, 2024, 3 pages, available at: https://www.ebay.ca/itm/314834459325.

Seasonofdreams via eBay "Nickelodeon Paw Patrol Skye Plush Bouncer Teddy Bear Toy—New Paw Patrol", retrieved on Mar. 27, 2024, 3 pages, available at: https://www.ebay.ca/itm/314834459158?itmmeta=01HT0E2DDBK95Y9FFB6WVDJ351&hash=item494d989a16:g:pBUAAOSwrOBlaBih&itmprp=enc%3AAQAJAAABEBmRGE1SEdSOMXAw3pzabnLk4eUoAYF3dw39xldrppLabC70Jr%2FpLw75kMpBksn6d75YK84i30qw2PI9IQW3p%2BIMKZ0Z%2Fay0pbJEFmbCIGfkOA%2BM3g4ze6bE0vf%2BFqhuGd.

Camp NYC, Inc. "JellyCat Amusable Tennis Ball", retrieved on Mar. 27, 2024, 3 pages, available at: https://camp.com/products/jellycat-amusable-tennis-ball?variant=43960185389210&currency=USD&tw_source=google&tw_adid=637088618783&tw_campaign=15292320441 &gad_source=1&gclid=EAlalQobChMI1cGz5bTvhAMVIFxHAR2r2gLvEAQYBiABEgK8_fD_BWE.

Extended European Search Report for European Patent Application No. 24161934.5, dated Aug. 27, 2024, 7 pages.

International Search Report and Written Opinion for corresponding International Application No. PCT/US2024/021738, mailed May 7, 2024, 7 pages.

* cited by examiner

BOUNCING TOY WITH PLUSH EXTERIOR

FIELD

The present invention relates generally to plush toys. More particularly, the present invention relates to a bouncing toy with a plush exterior.

BACKGROUND

Conventional bouncing balls typically have a smooth and hard exterior. For example, the "Super Ball", disclosed in U.S. Pat. No. 3,241,834, is an extremely resilient, rigid ball or sphere. The Super Ball is capable of a high bounce due to the highly compressed polybutadiene rubber. While these balls bounce well, the exterior of the Super Ball is smooth and plain.

Conventional plush toys are also known. An example of a spherical, plush toy is the Ty Beanie Ballz® line of plush toys, sometimes called Ty Puffies®. These plush balls have a soft, fluffy exterior and generally include a fun character face. Beanie Ballz® are tossable and soft, but they do not meaningfully bounce because they are filled with stuffing material similar to a stuffed animal. Other plush toys exist, but none of these plush toys sufficiently bounce to provide the fun and enjoyment of conventional bouncing balls.

In view of the above, there is a continuing, ongoing need for improved plush toys.

DETAILED DESCRIPTION

Figure 1:
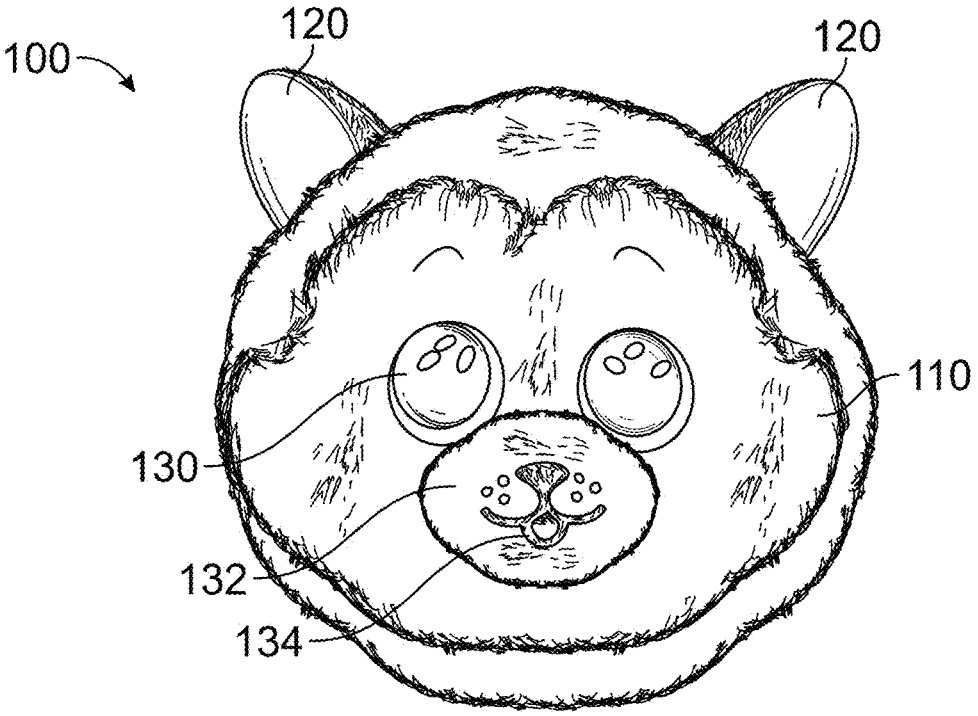
FIG. 1 illustrates a bouncing plush toy according to an embodiment.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include a bouncing ball toy with a plush fabric exterior. The plush fabric exterior can be formed over an internal bouncing ball structure such that the plush fabric exterior does not significantly impact or dampen the ability of the internal bouncing ball structure to bounce when impacting a hard object. The interior ball structure may comprise highly resilient materials and provide significant bounce and liveliness after impacting a hard object. Indeed, the interior ball structure can provide ample bounce and liveliness even when surrounded by the plush fabric exterior such that the bouncing ball toy with the plush fabric exterior still provides fun and enjoyment in bouncing the ball.

In some embodiments, the plush fabric exterior can include fabric or other fibers that provide a fur-like texture on the bouncing ball toy. The plush fabric may comprise a pile to give the plush fabric a raised or fuzzy surface. The pile may give the plush fabric the fur-like texture. In some embodiments, the pile length can be 3-50 mm in length, but the pile length can be any length. In one embodiment, the pile length can be 5 mm in length because longer pile lengths may affect bounce. In some embodiments, the pile length of the plush fabric exterior can depend on the character or animal depicted by bouncing ball toy. According to another embodiment, plush fabric exterior can include sewn on facial features, such as eyes, muzzles, and mouths, and sewn on extremities, such as ears, whiskers, legs, or arms. In an embodiment that includes facial features and extremities, the facial features can be formed using stiff fabrics, such as cotton, polyester, or nylon thread, to generate a hard surface after weaving so that the facial features do not significantly impact bouncing. In an embodiment having extremities, the extremities may comprise soft and pliable fabric that does not affect bouncing of the bouncing ball toy.

Embodiments of the bouncing ball toy disclosed herein can provide a multi-functional experience for a child or other user. The bouncing ball toy can provide a soft, plush toy experience on the surface while also bouncing like a bouncy ball during play, thereby adding extra fun and experience for a user of the bouncing ball toy. In some embodiments, the bouncing ball toy can include animal, cartoon, or other faces on the balls to make the toy pleasing in appearance and appeal to children. Moreover, the plush fabric may include the pile described above to generate a three-dimensional fiber having the appearance of fur to make the toy cuddly and fun to hold without bouncing.

The embodiments of the bouncing ball toy with the plush fabric exterior disclosed herein can be spherical in shape according to any diameter, but in a preferred embodiment, the bouncing ball toy can be small enough to be grippable by a child (e.g., 5-10 cm in diameter). However, other diameter sizes are envisioned (e.g. 10 inches in diameter, approximately the size of a kickball).

The plush fabric exterior is attached to the interior ball structure in a manner that does not significantly affect bounce or liveliness. Even when covered with the plush fabric, the bouncing ball toy with the plush exterior can bounce off a hard surface 55-70% of a height dropped (e.g., dropping the ball from a height of 3 feet can result in a bounce of two feet). The impressive bouncing performance of the bouncing ball toy may be generated by the combination of an internal ball structure comprising a highly resilient material, such as polyurethane, and careful attachment of the plush fabric exterior to the internal ball structure to ensure a tight fit without wrinkles or air bubbles between an exterior surface of the internal ball structure and the plush fabric exterior.

Figure 2:
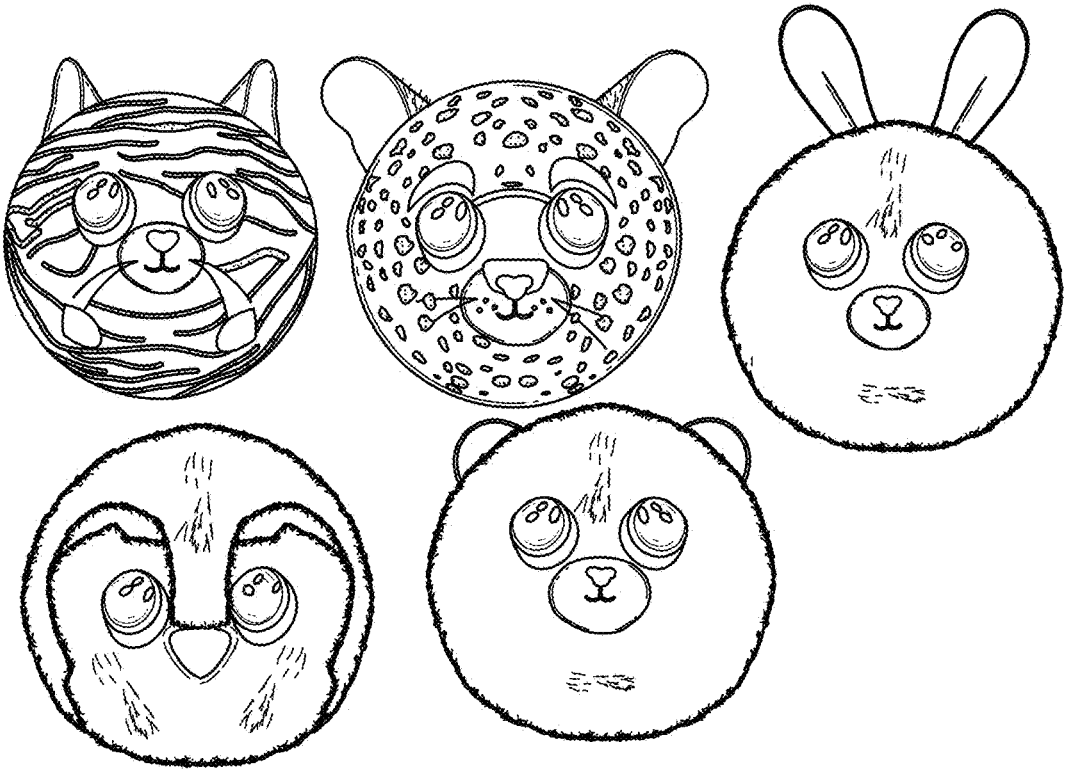
FIG. 2 illustrates various character or animal designs that can be included on a bouncing plush toy according to an embodiment.

FIG. 1 illustrates a bouncing plush toy with a plush fabric exterior 100 according to an embodiment. As shown, the bouncing plush toy 100 can include a plush fabric exterior 110, extremities 120, and facial features 130-134 formed on the plush fabric exterior. According to an exemplary embodiment, the bouncing ball toy 100 can resemble an animal or other cartoon character. The embodiment illustrated in FIG. 1 depicts a bouncing ball toy 100 having a husky dog character with ear extremities 120 and facial features 130-134, which include eyes 130, a snout 132, and a mouth 134. Other characters or animals can be depicted using different plush fabric colors, different extremities, and different facial features, as shown in FIG. 2. In addition, the various characters and animals can include plush fabric exteriors having different pile lengths.

Referring again to FIG. 1, the bouncing ball toy 100 can be spherical in shape. The plush fabric exterior 110 can include a pile (e.g. 5-40 mm) giving the plush fabric a three-dimensional sense that can emulate fur of the animal character depicted by the extremities 120 and the facial features 130-134.

The extremities 120 may be sewn to the plush fabric exterior 110 at the base of the plush fabric exterior 110 or beneath the pile pf the plush fabric exterior 110. In other words, the extremities may not attach to the fibers forming the pile of the plush fabric exterior 110. The extremities 120 can comprise a soft and pliable fabric so as not to impact bouncing of the bouncing ball toy 100, such as causing the bouncing ball to carom unexpectedly or ricochet off the extremities 120. The extremities 120 may be cut separately using a stencil or other guide and sewn using thin, but stiff threads. Again, the thread is chosen so as not to damped or impact bouncing of the bouncing ball toy 100. In some embodiments, the extremities 120 may comprise a plush fabric having a shorter pile length than the plush fabric exterior 100. In most embodiments, the extremities may not attach to the plush fabric exterior via glue or other adhesive as these materials may affect consistent bouncing of the bouncing ball toy.

Figure 3A:
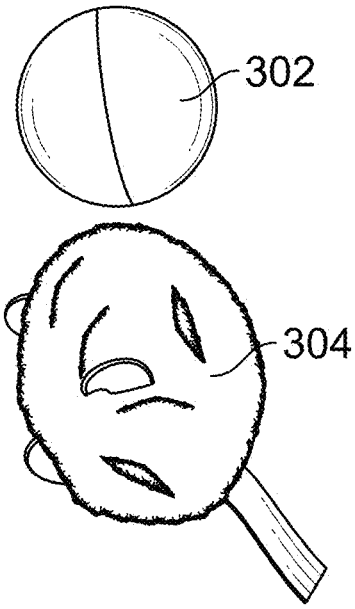
FIGS. 3A through 3D illustrate a method for forming the bouncing plush toy according to an exemplary embodiment.
Figure 3B:
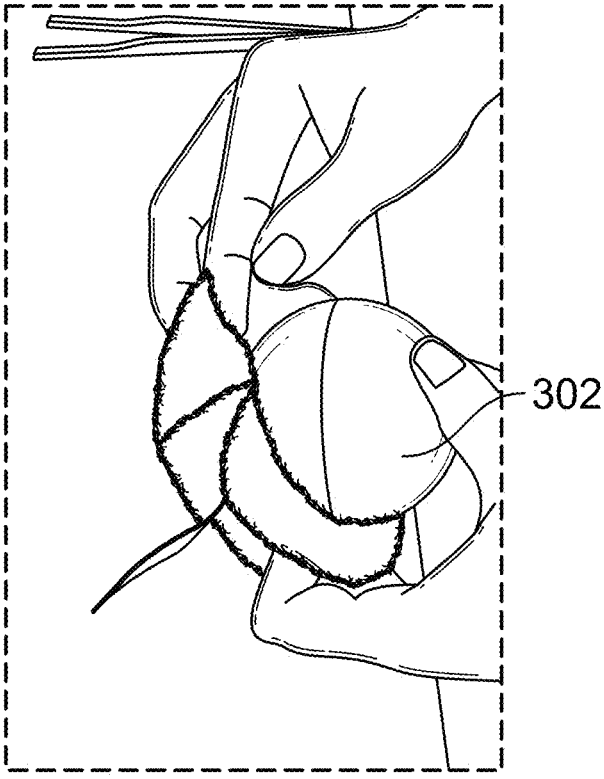

The bouncing ball toy 100 includes an internal ball structure, not seen in FIG. 1 because the plush fabric exterior 100 can completely cover the internal ball structure. Referring to FIG. 3A, the internal ball structure 302 can be seen with a plush fabric skin 304 (formed by a sewing profile described later with reference to FIG. 4). The plush fabric skin 304 may comprise the plush fabric exterior 110, the extremities 120, and the facial features 130-134 described with reference to FIG. 1. That is, the skin 304 can be fully formed before stuffing the skin 304 with the internal ball structure 302. The skin 304 may be spherical in shape and may have a pocket for accepting the internal ball structure. The closing seam, when open, can provide an opening into the pocket before the closing seam is closed to cover the internal ball structure, and the closing seam may have substantially the same length as the diameter of the internal ball structure. As shown in FIG. 3B, the internal ball structure 302 is inserted, or stuffed, into the plush fabric skin 304 through an unsewn seam 306 in the plush fabric skin 304. The plush fabric skin 304 has a size and shape that corresponds with the diameter of the internal ball structure 302, and the plush fabric skin 304 can fit tightly over the internal ball structure. In addition, the seam 306 in the plush fabric skin 304 can be the substantially the same length as the diameter of the internal ball structure 302.

Figure 3C:
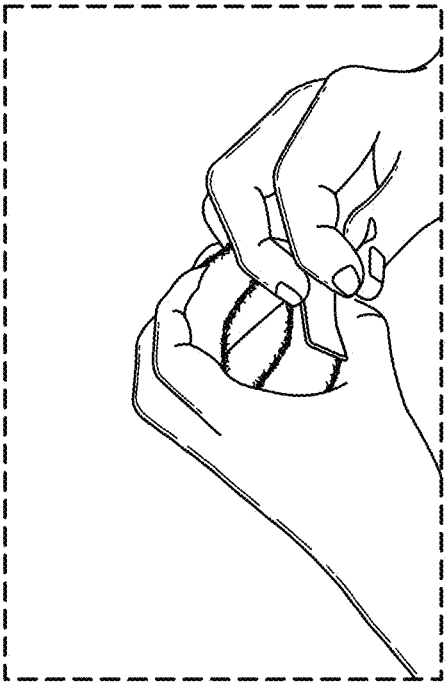
Figure 3D:
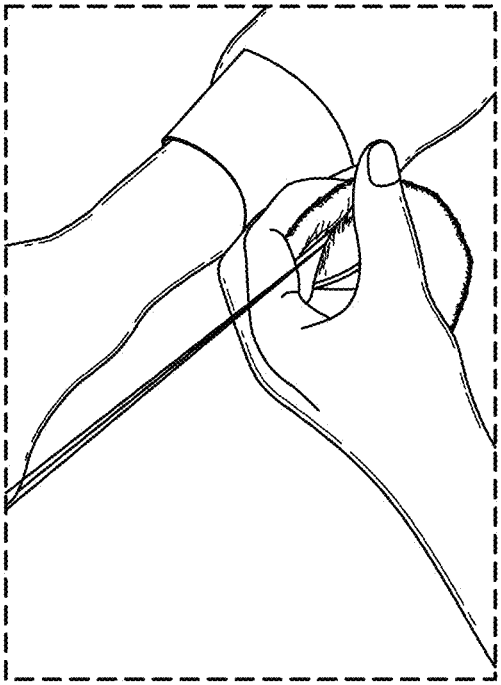

As shown in FIG. 3C, the seam 306 is closed tightly over the internal ball structure, and, as shown in FIG. 3D, the seam can be tightly sewn closed using stiff thread and by stretching the plush fabric skin 304 over the internal ball structure 302 to minimize wrinkles in the plush fabric skin 304 that may dampen or substantially hinder the ability of the internal ball structure 302 to provide bouncing enjoyment. To prevent wrinkles, air bubbles, or any other hinderances to tight wrapping of the plush fabric skin 304 over the internal ball structure 302, the plush fabric skin 304 may include relatively few patterns and a relatively long sewing seam. In one embodiment, the seam 306 may be the same or substantially the same length as the diameter of the internal ball structure 302. In addition, a sewing pattern (shown in FIG. 4) must be very accurate on arc length and symmetrical.

In some embodiments, the plush fabric skin 304 may attach to the internal ball structure 302 without glue or other adhesive because glue may dampen bouncing. Moreover, to ensure bouncing, a sewing margin while sewing the seam must be even. In addition, the seam 306 must be sewn very tightly, with stiff thread, and with sufficient force by any sewing workmanship to ensure tight fitting of the plush fabric skin 304 over the internal ball structure 302.

In some embodiments, the internal ball structure 302 may comprise polyurethane to provide a highly resilient structure that bounces off hard objects. In a preferred embodiment, a polyurethane material of the internal ball structure 302 may comprise a chemical composition according to Table 1.

TABLE 1

| Chemical Name | CAS Number | Percentage |
|---|---|---|
| Toluene Diisocyanate (TDI) | 26471-62-5 | 74% |
| Polyether Polyol (PPG) | 90031 1-6 | 23% |
| Tin Octoate | 30110-0 | 1% |
| Silicone Oil | Nil | 1% |
| Color Cream (PM-433) | Ni | 1% |

However, any highly resilient materials are envisioned for the internal ball structure 302, including stiff rubbers or other highly resilient polymers. In some embodiments, the internal ball structure 302 may comprise foam, but the foam internal ball structure 302 may not provide sufficient bouncing response for some applications.

In some embodiments, the plush fabric 110 may comprise XTM fabric. The XTM fabric may include fibers of 5 mm pile length and 450 grams/yard. However, any plush fabric is envisioned for the plush fabric 110.

Figure 4:
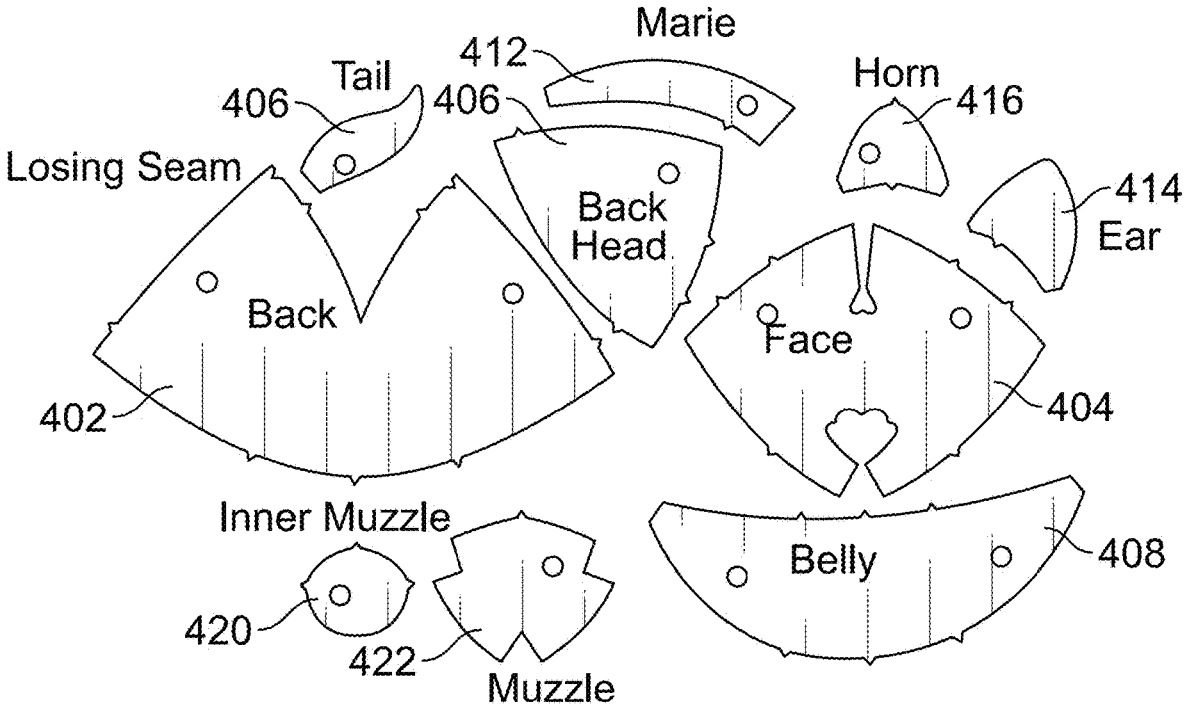
FIG. 4 illustrates a sewing pattern for forming a bouncing plush toy according to an embodiment.

The plush fabric skin 304 can be formed by a sewing pattern 400 shown in FIG. 4. The sewing pattern 400 can include a plurality of sewing pattern sections the result in a spherical skin. The sewing pattern 400 can include plush fabric exterior sections, including a back section 402, a face section 404, a back head section 406, and a belly portion 408. The plush fabric exterior sections 402-408 are sewn together to form the plush fabric exterior 110. Notable the back section 402 includes the closing seam 306 along a side of the back section described above. The sewing pattern 400 shown in FIG. 4 is exemplary, and other sewing patterns are envisioned based on the character or animal depicted by the bouncing ball toy 100.

In addition to the plush fabric exterior sections 402-408, the sewing pattern 400 can include extremity sections, including a tail section 410, a mane section 412, an ear section 414, and a horn section 416. The number and types of extremity sections 410-416 can depend on the character or animal depicted by the bouncing ball toy 100.

Further still, the sewing pattern 400 can include facial feature sections, such as inner muzzle section 420 and muzzle section 422. The muzzle section 422 may cover and overlap with the inner muzzle section 420 so that the muzzle or snout can be slightly raised over the plush fabric exterior 110, giving the appearance and sensation of a small nose or snout. The combination of the inner muzzle section 420 and muzzle section 422 may be sufficiently hard so as not to overly dampen the bouncing of the bouncing ball toy.

Figure 5:
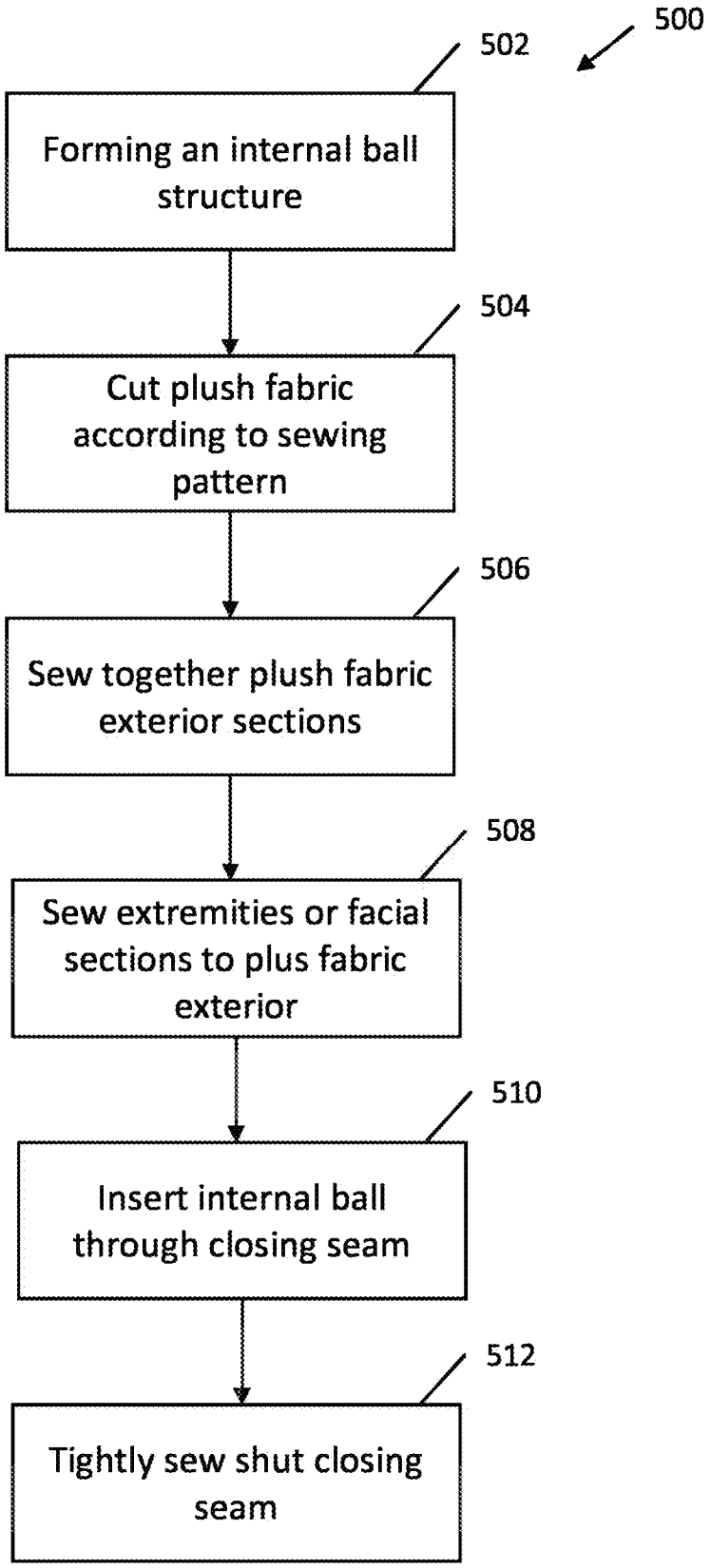
FIG. 5 illustrates a method of manufacture for the bouncing ball toy according to an exemplary embodiment.

FIG. 5 illustrates a method of manufacturing 500 the bouncing ball toy of the exemplary embodiments described herein. As shown in FIG. 5, the method 500 may include forming the internal ball structure in step 502. In some embodiments, the internal ball structure is pre-formed and purchased or formed using known methods. Additionally, the method 40 may include cutting a plush fabric according to a sewing pattern, such as the sewing pattern illustrated in FIG. 4, in step 504. In step 506, the plush fabric exterior sections may be sewn together to form the plush fabric exterior 110. A stitcher or machine may leave open the closing seam 306 as part of the sewing step 506. The method may further include sewing any extremities or facial features into the plush fabric exterior or any unsewn portions of the plush fabric exterior to form the plush fabric skin 304 in step 508. Subsequently, the internal ball structure 302 is inserted into the plush fabric skin 304 through the closing seam 306 in step 510, and subsequently the closing seam is tightly sewn shut in step 512. The plush toy skin 304 may be stretched over the internal ball structure as the closing seam is sewn shut to ensure no wrinkles when the plush toy skin 304 covers the internal ball structure 302.

The bouncing ball toy with the plush fabric exterior solves the problems over the prior art because the bouncing ball toy with the plush fabric exterior provides both a fun and engaging bouncing ball that includes interesting, soft, and cuddly exterior, thereby providing a multifunctional toy experience.

Although a few embodiments have been described in detail above, other modifications are possible. For example, the steps described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A toy comprising:

an internal ball structure comprising a highly resilient material capable of bouncing off a surface;

a plush fabric skin having a plush fabric exterior configured to completely cover the internal ball structure such that the plush fabric exterior does not significantly impact or dampen the ability of the internal bouncing ball structure to bounce when impacting a surface;

extremities comprising a pliable fabric sewn on to the plush fabric exterior of the plush fabric skin, wherein the pliable fabric is chosen to prevent causing the toy to carom or ricochet off the extremities;

facial features sewn over the plush fabric exterior of the plush fabric skin, wherein the facial features are configured to prevent dampening of a bounce of the toy; and wherein the diameter of the internal ball structure allows for the toy to be grippable by a child.

2. The toy of claim 1, wherein the highly resilient material comprises polyurethane.

3. The toy of claim 2, wherein the polyurethane comprises toluene diisocyantate, polyether polyol, tin octoate, silicone oil, and color cream.

4. The toy of claim 1 wherein the plush fabric skin comprises a pile to give the plush fabric a fur-like texture.

5. The toy of claim 4 wherein the pile length is 3-50 mm.

6. The toy of claim 1 wherein the plush fabric skin comprises XTM fabric.

7. The toy of claim 1 wherein the plush fabric skin is attached to the interior ball structure in a manner that does not significantly affect bounce or liveliness by stretching the plush fabric skin over the internal ball structure and tightly sewing a closing seam.

8. The toy of claim 1, wherein the toy resembles an animal or cartoon character.

9. The toy of claim 1, wherein the plush fabric skin is designed to be spherical in shape and having a pocket for accepting the internal ball structure, wherein an open closing seam provides an opening into the pocket before the closing seam is closed to cover the internal ball structure, and wherein the closing seam has substantially the same length as the diameter of the internal ball structure.

10. The toy of claim 1, wherein the toy is configured to bounce off a surface 55-70% of a height dropped.

11. The toy of claim 1, wherein the plush fabric skin is configured to stretch over the internal ball structure.

12. A method of manufacture comprising:

forming an internal ball structure comprising a highly resilient material capable of bouncing off a surface;

cutting a sewing pattern to create a plurality of plush fabric portions;

sewing together the plurality of plush fabric portions according to the sewing pattern to form a spherical plush fabric skin;

leaving open a closing seam on the plush fabric skin, wherein the closing seam is substantially the same diameter as the diameter of an internal ball structure;

inserting the internal ball structure into the plush fabric skin through the closing seam;

tightly sewing the seam closed to cover the internal ball structure with the plush fabric skin;

cutting extremity portions in a pliable fabric according to the sewing pattern;

sewing the extremity portions to the plush fabric skin;

cutting facial features according to the sewing pattern; and sewing the facial features over the plush fabric skin, wherein the pliable fabric of the extremity portions is chosen to prevent causing the toy to carom or ricochet off the extremities, and wherein the facial features are configured to prevent dampening of a bounce of the internal ball structure.

13. The method of claim 12, wherein the highly resilient material comprises polyurethane.

14. The method of claim 13, wherein the polyurethane comprises toluene diisocyantate, polyether polyol, tin octoate, silicone oil, and color cream.

15. The method of claim 12 wherein the plush fabric skin comprises a pile to give the plush fabric a fur-like texture.

16. The method of claim 15 wherein the pile length is 3-50 mm.

17. The method of claim 12 wherein the plush fabric skin comprises XTM fabric.

18. A toy comprising:

an internal ball structure comprising a highly resilient material capable of bouncing off a surface; and a plush fabric skin having a plush fabric exterior configured to completely cover the internal ball structure such that the plush fabric exterior does not significantly impact or dampen the ability of the internal bouncing ball structure to bounce when impacting a surface extremities comprising a pliable fabric sewn on to the plush fabric exterior of the plush fabric skin, wherein the pliable fabric is chosen to prevent causing the toy to carom or ricochet off the extremities;

facial features sewn over the plush fabric exterior of the plush fabric skin, wherein the facial features are configured to prevent dampening of a bounce of the internal ball structure, wherein the plush fabric skin comprises a pile to give the plush fabric a fur-like texture, and wherein the pile length is 3-10 mm; and wherein the diameter of the internal ball structure allows for the toy to be grippable by a child.

* * * * *